US012601027B2

(12) United States Patent
Sung

(10) Patent No.: US 12,601,027 B2
(45) Date of Patent: Apr. 14, 2026

(54) STEEL MATERIAL HAVING EXCELLENT HYDROGEN EMBRITTLEMENT RESISTANCE AND IMPACT TOUGHNESS AND METHOD FOR MANUFACTURING

(71) Applicant: POSCO Co., Ltd, Pohang-si (KR)

(72) Inventor: Hyun-Je Sung, Seoul (KR)

(73) Assignee: POSCO CO., LTD, Pohang-si (KR)

( * ) Notice: Subject to any disclaimer, the term of this patent is extended or adjusted under 35 U.S.C. 154(b) by 503 days.

(21) Appl. No.: 18/017,481

(22) PCT Filed: Jul. 20, 2021

(86) PCT No.: PCT/KR2021/009333
§ 371 (c)(1),
(2) Date: Jan. 23, 2023

(87) PCT Pub. No.: WO2022/030818
PCT Pub. Date: Feb. 10, 2022

(65) Prior Publication Data

US 2023/0357878 A1 Nov. 9, 2023

(30) Foreign Application Priority Data

Aug. 7, 2020 (KR) ..... 10-2020-0099305

(51) Int. Cl.

| | |
|---|---|
| ***C21D 9/46*** | (2006.01) |
| ***C21D 8/02*** | (2006.01) |
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/48*** | (2006.01) |
| ***C22C 38/54*** | (2006.01) |

(52) U.S. Cl.
CPC ..... *C21D 9/46* (2013.01); *C21D 8/0205* (2013.01); *C21D 8/0226* (2013.01); *C21D 8/0273* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/48* (2013.01); *C22C 38/54* (2013.01); *C21D 2211/008* (2013.01)

(58) Field of Classification Search
CPC ..... C22C 38/44
See application file for complete search history.

(56) References Cited

U.S. PATENT DOCUMENTS

| | | | | |
|---|---|---|---|---|
| 2004/0047757 | A1 | 3/2004 | Takayama | |
| 2009/0277539 | A1 | 11/2009 | Kimura et al. | |
| 2012/0132327 | A1 | 5/2012 | Muikai et al. | |
| 2016/0060721 | A1 | 3/2016 | Nagao et al. | |
| 2016/0060738 | A1 | 3/2016 | Nagao et al. | |
| 2016/0208352 | A1 | 7/2016 | Suikkanen et al. | |
| 2017/0073792 | A1 * | 3/2017 | Hikida | C21D 8/0226 |
| 2018/0312935 | A1 | 11/2018 | Nagao et al. | |
| 2022/0002851 | A1 | 1/2022 | Kim et al. | |
| 2022/0025477 | A1 | 1/2022 | Sung et al. | |

FOREIGN PATENT DOCUMENTS

| | | | | |
|---|---|---|---|---|
| CN | 104024461 | A | 9/2014 | |
| CN | 105102653 | A | 11/2015 | |
| CN | 105189803 | A | 12/2015 | |
| CN | 109136737 | A | 1/2019 | |
| CN | 111088461 | A | 5/2020 | |
| EP | 2832879 | B1 | 11/2019 | |
| JP | S62-205217 | A | 9/1987 | |
| JP | 2003-286543 | A | 10/2003 | |
| JP | 2003-328078 | A | 11/2003 | |
| JP | 2004-323951 | A | 11/2004 | |
| JP | 2012-47629 | A | 3/2012 | |
| JP | 2014-173160 | A | 9/2014 | |
| JP | 2018-012855 | A | 1/2018 | |
| JP | 2019-183218 | A | 10/2019 | |
| JP | 6673535 | B1 | 3/2020 | |
| KR | 10-2015-0125986 | A | 11/2015 | |
| KR | 10-2016-0078573 | A | 7/2016 | |
| KR | 10-1726086 | B1 | 4/2017 | |
| KR | 10-2018-0038024 | A | 4/2018 | |
| KR | 10-2020-0065150 | A | 6/2020 | |
| KR | 10-2020-0066512 | A | 6/2020 | |
| KR | 10-2020-0075964 | A | 6/2020 | |
| WO | WO-2015174530 | A1 * | 11/2015 | B22D 11/001 |
| WO | 2020/111857 | A1 | 6/2020 | |

OTHER PUBLICATIONS

Office Action issued Mar. 5, 2024 for Japanese Patent Application No. 2023-507838.

"Ingredients and mechanical properties (tensile strength, yield point, elongation, drawing, hardness) of SNCM625 (nickel chromium molybdenum steel)", 2010, 2 pages total, https://www.toishi.info/sozai/sncm/sncm625.html, (See English Abstract).

(Continued)

*Primary Examiner* — Jophy S. Koshy
(74) *Attorney, Agent, or Firm* — Morgan Lewis & Bockius LLP

(57) ABSTRACT

A steel material is disclosed that exhibits improved hydrogen embrittlement resistance and high impact toughness despite a low-cost alloy system compared to conventional steel. The steel material can be advantageously applicable in the field using hydrogen such as hydrogen electric vehicles, hydrogen charging stations and the like, and a method for manufacturing the same.

4 Claims, 13 Drawing Sheets

(56) References Cited

OTHER PUBLICATIONS

"Ingredients and mechanical properties (tensile strength, yield point, elongation, drawing, hardness) of SNCM431 (nickel chromium molybdenum steel)", 2010, 2 pages total, https://www.toishi.info/sozai/sncm/sncm431.html, (See English Abstract).

"Ingredients and mechanical properties (tensile strength, yield point, elongation, drawing, hardness) of SNCM420 (nickel chromium molybdenum steel)", 2010, 2 pages total, https://www.toishi.info/sozai/sncm/sncm420.html, (See English Abstract).

"Nickel Chromium Molybdenum Steels", 1979, 2 pages total, https://www.forming.co.jp/database/pdf/ncms-1.pdf, (See English Abstract).

Office Action dated Aug. 31, 2024, issued in corresponding Chinese Patent Application No. 202180058109.9 with an English translation.

International Search Report dated Nov. 12, 2021 issued in International Patent Application No. PCT/KR2021/009333 (with English translation).

Extended European Search Report dated May 15, 2025 issued in corresponding European Patent Application No. 21852273.8. (Note: CN 111088461 A already submitted.).

* cited by examiner

[FIG. 1]
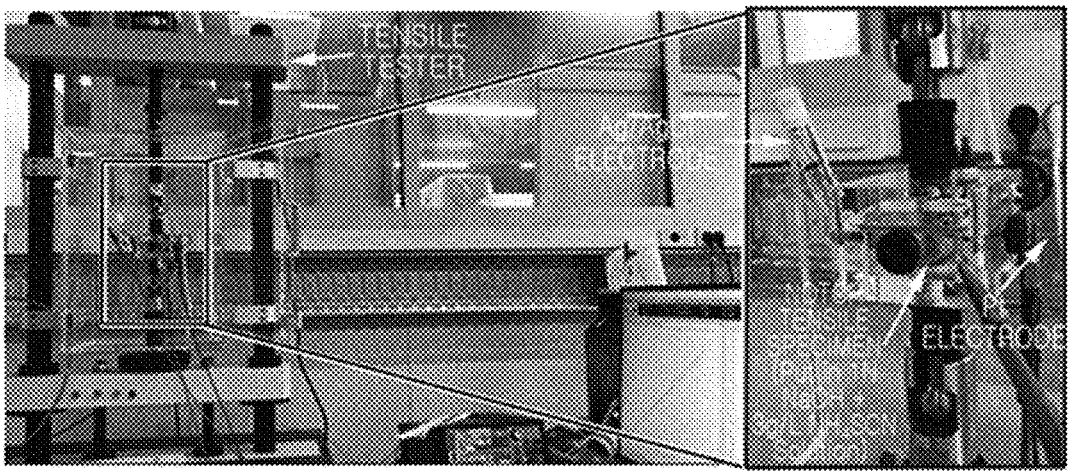
[FIG. 2a]
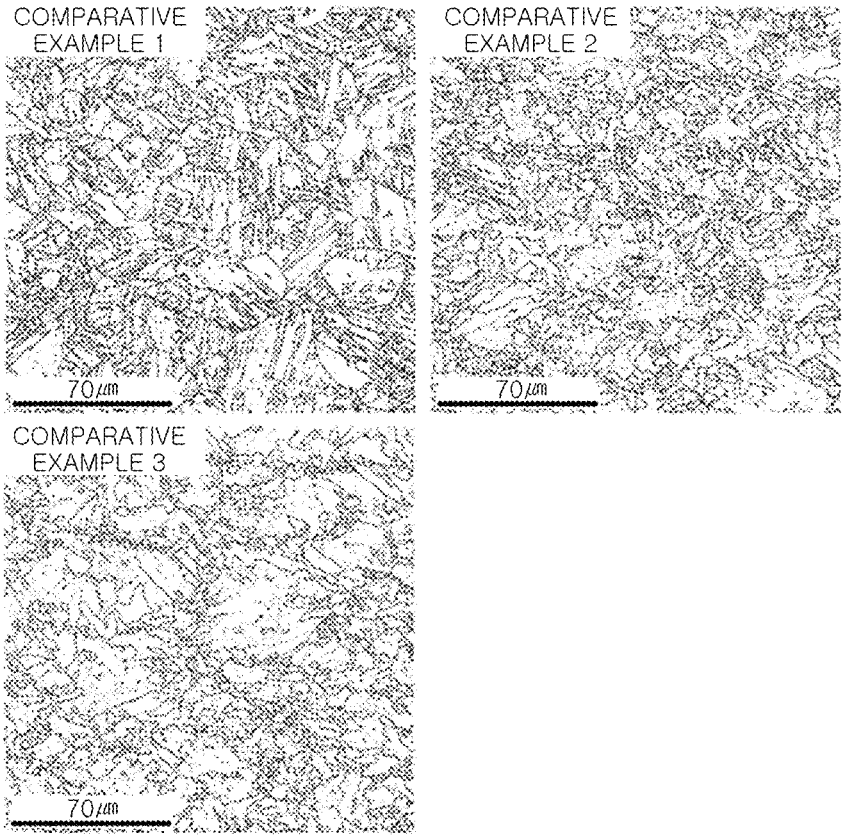

[FIG. 2b]
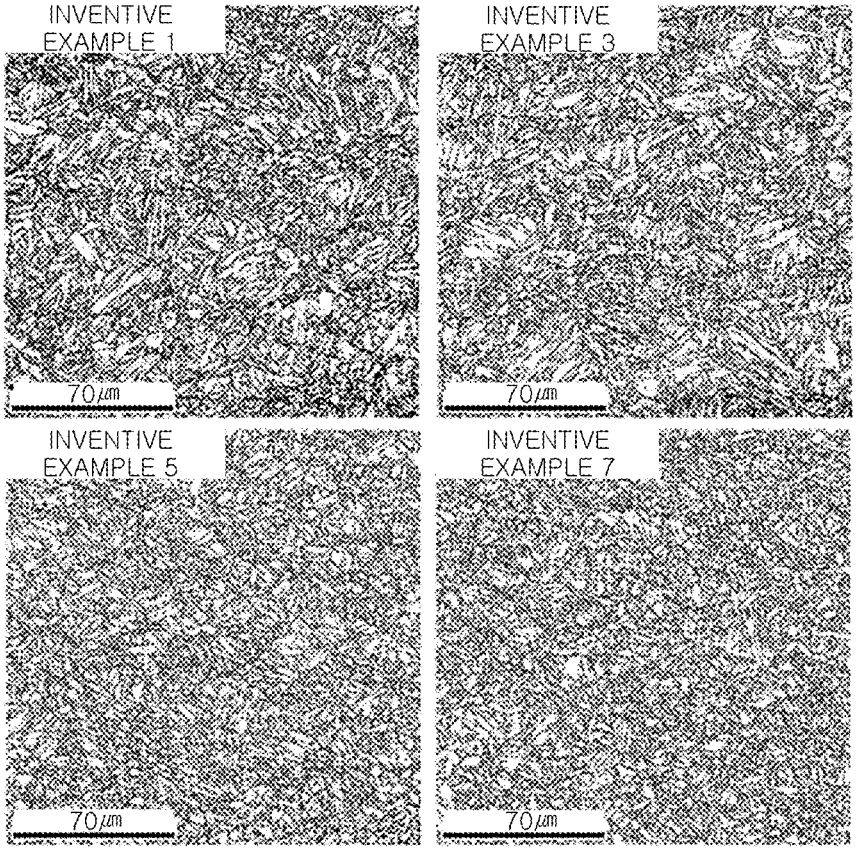

[FIG. 3a]
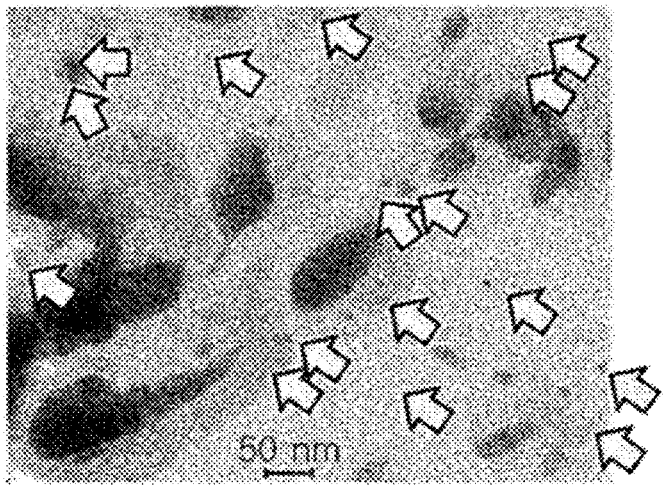
[FIG. 3b]
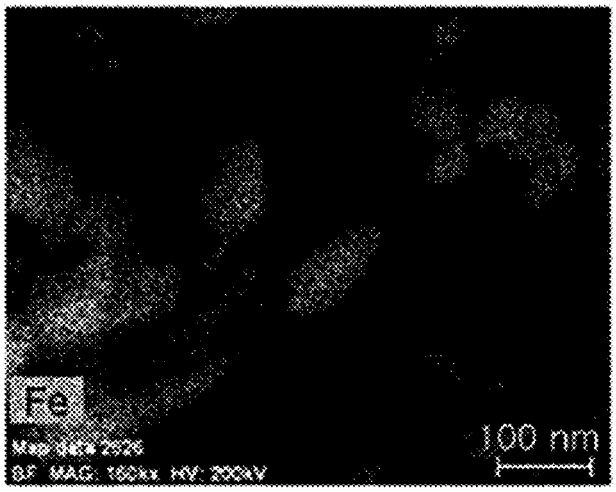

[FIG. 3c]
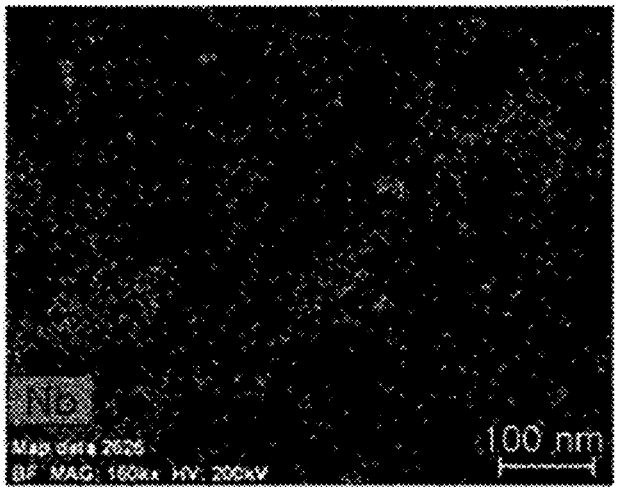

[FIG. 4]
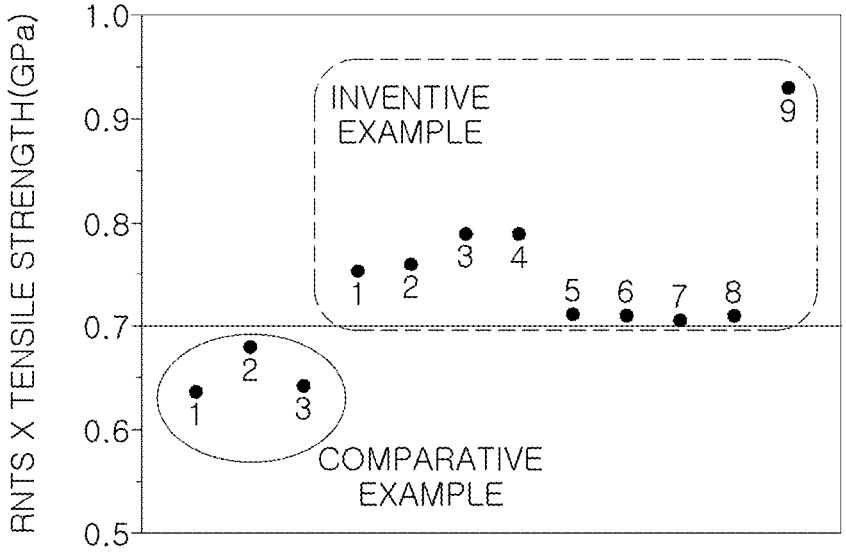

[FIG. 5a]
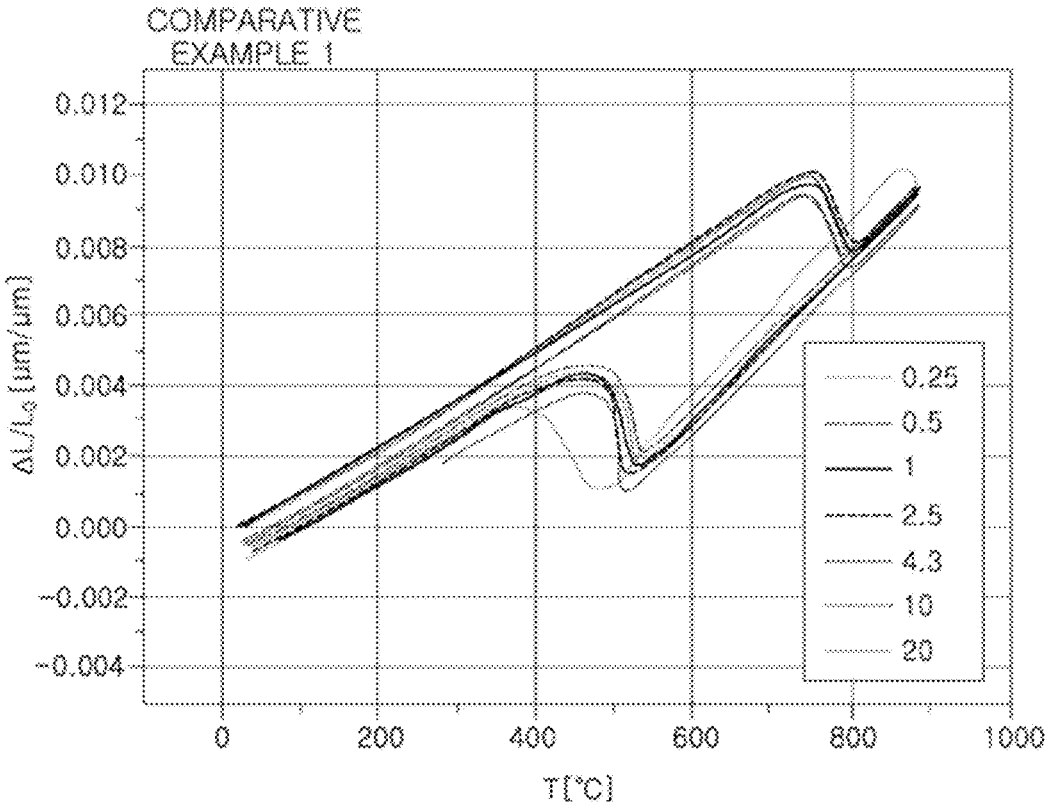

[FIG. 5b]
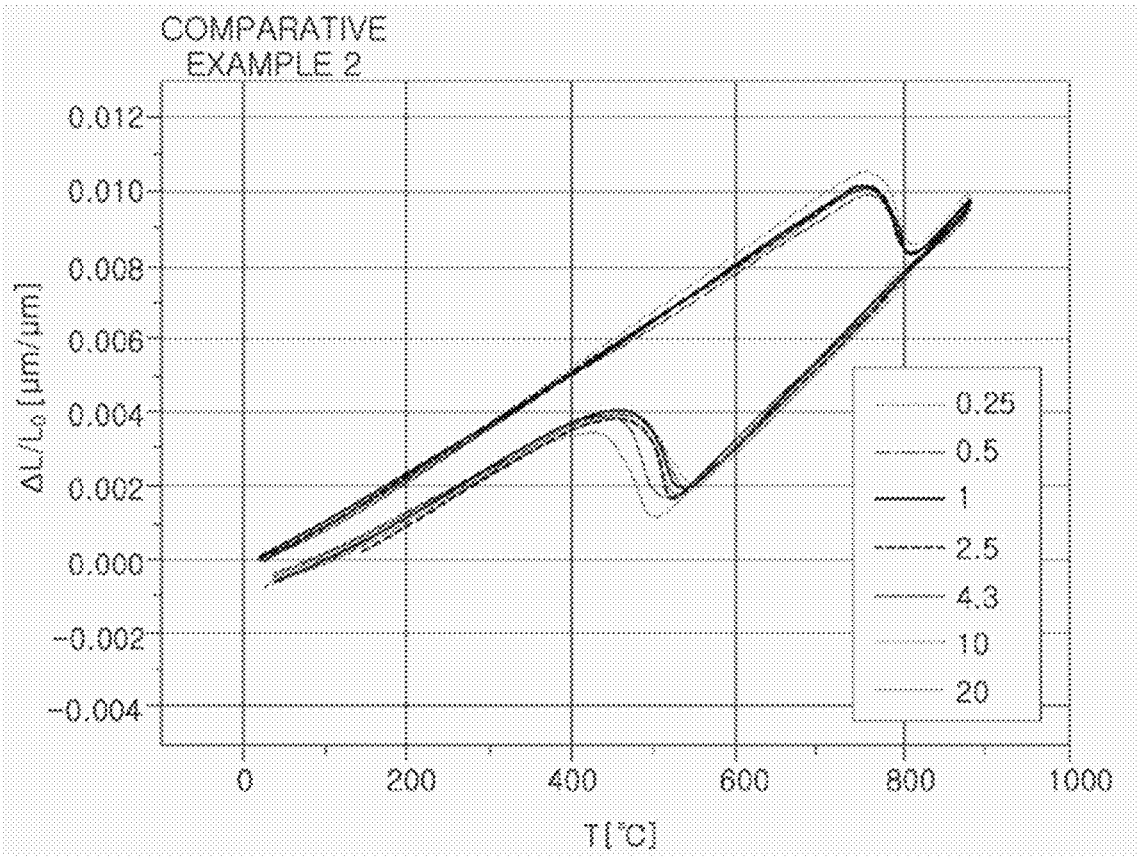

[FIG. 5c]
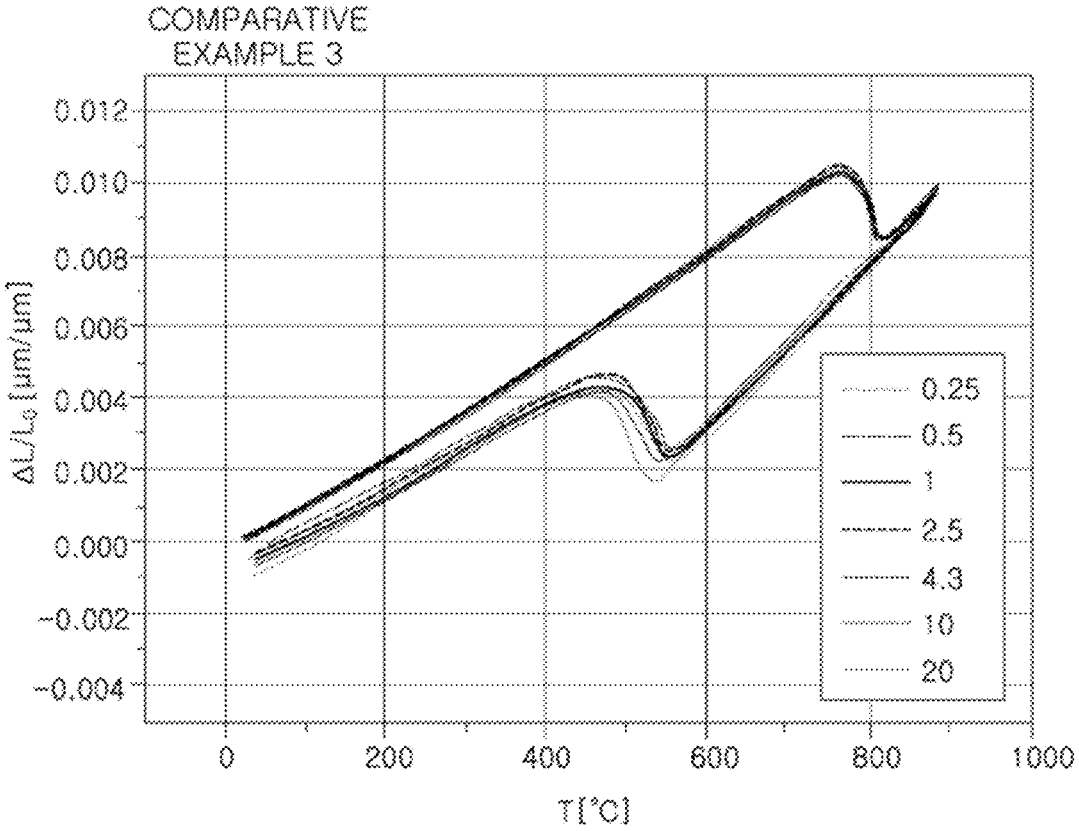

[FIG. 5d]
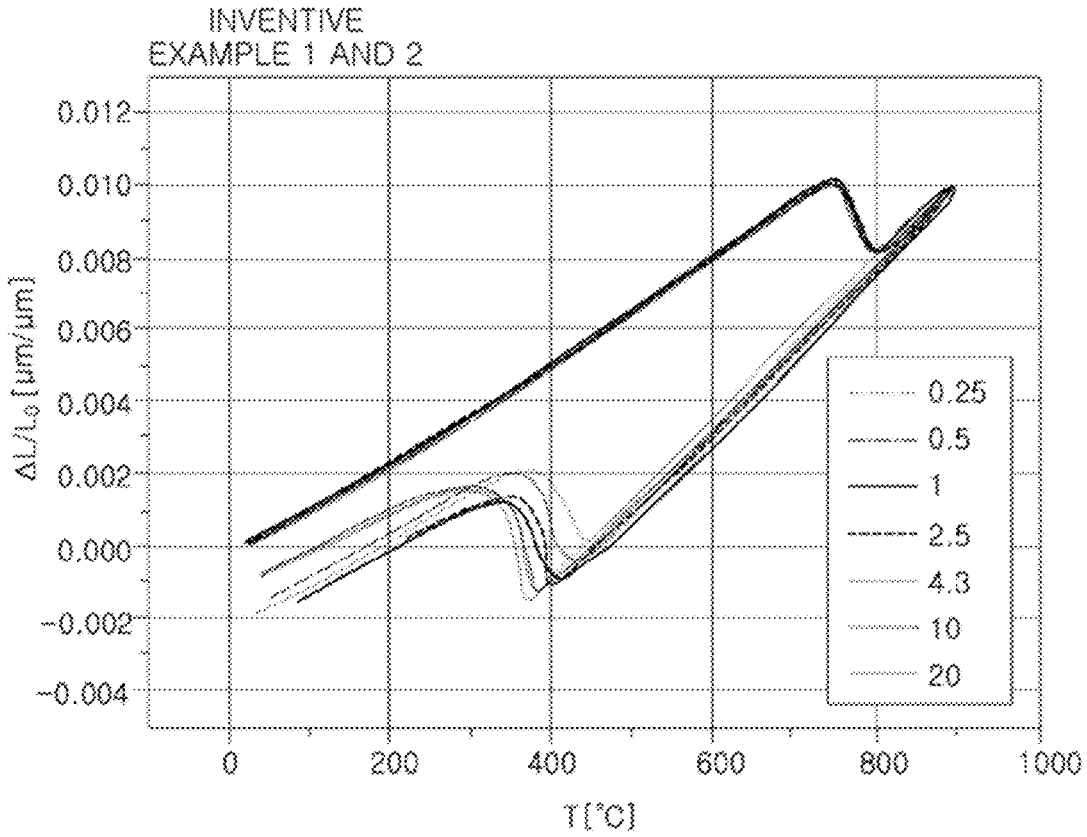

[FIG. 5e]
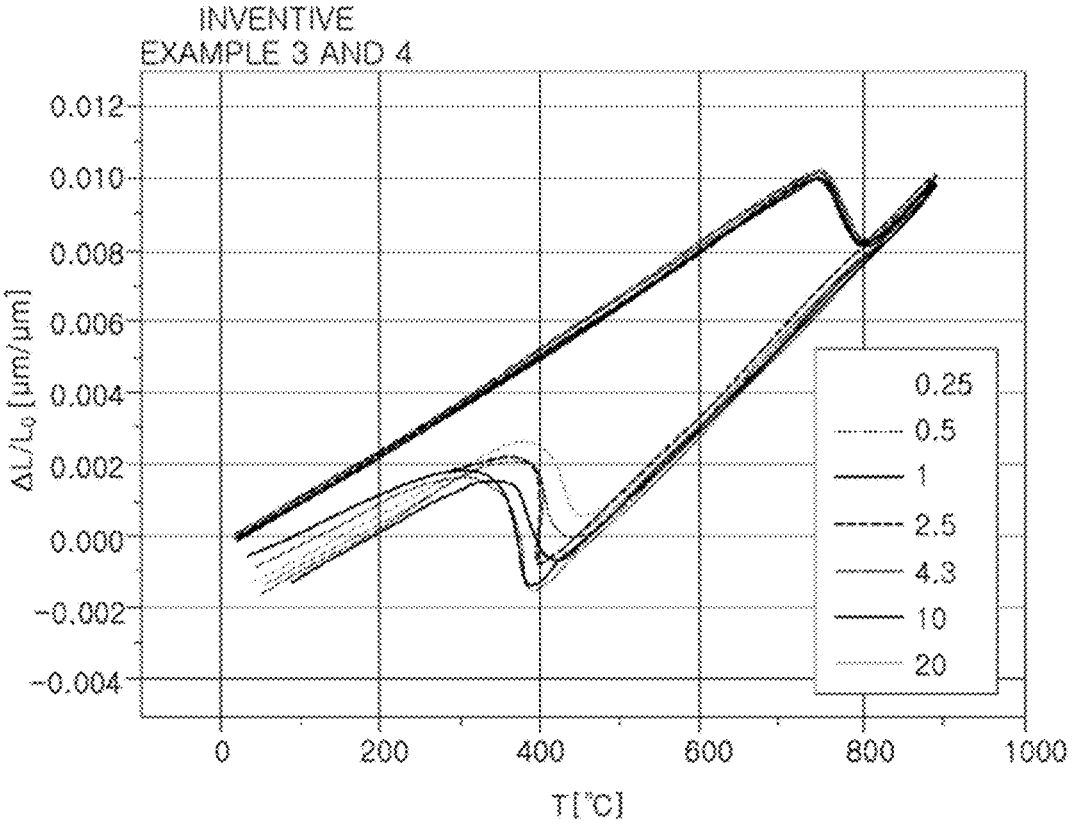

[FIG. 5f]
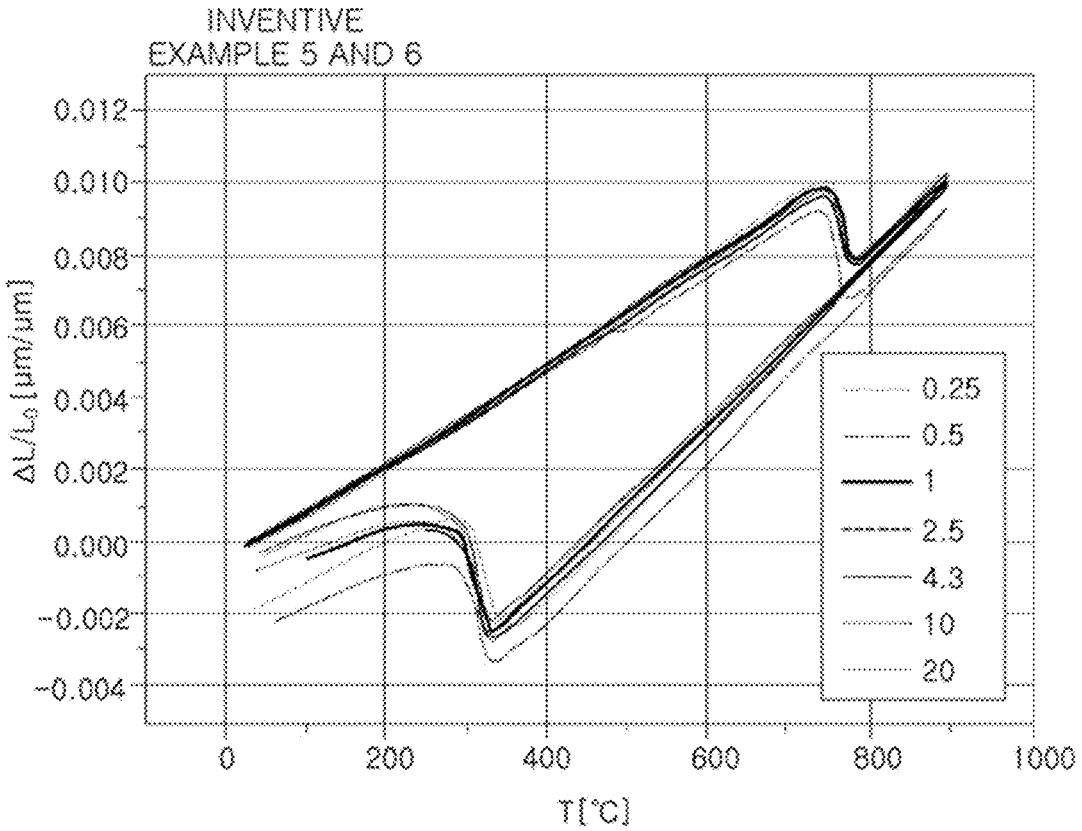

[FIG. 5g]
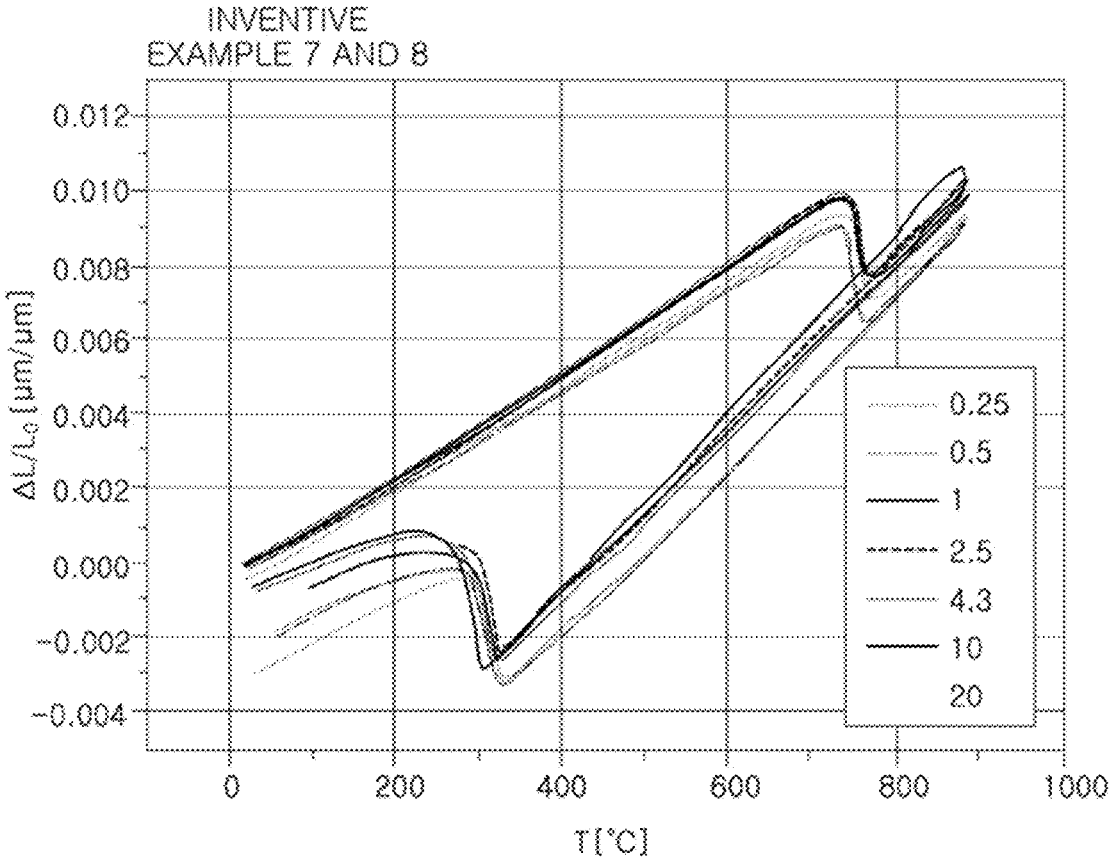

[FIG. 5h]
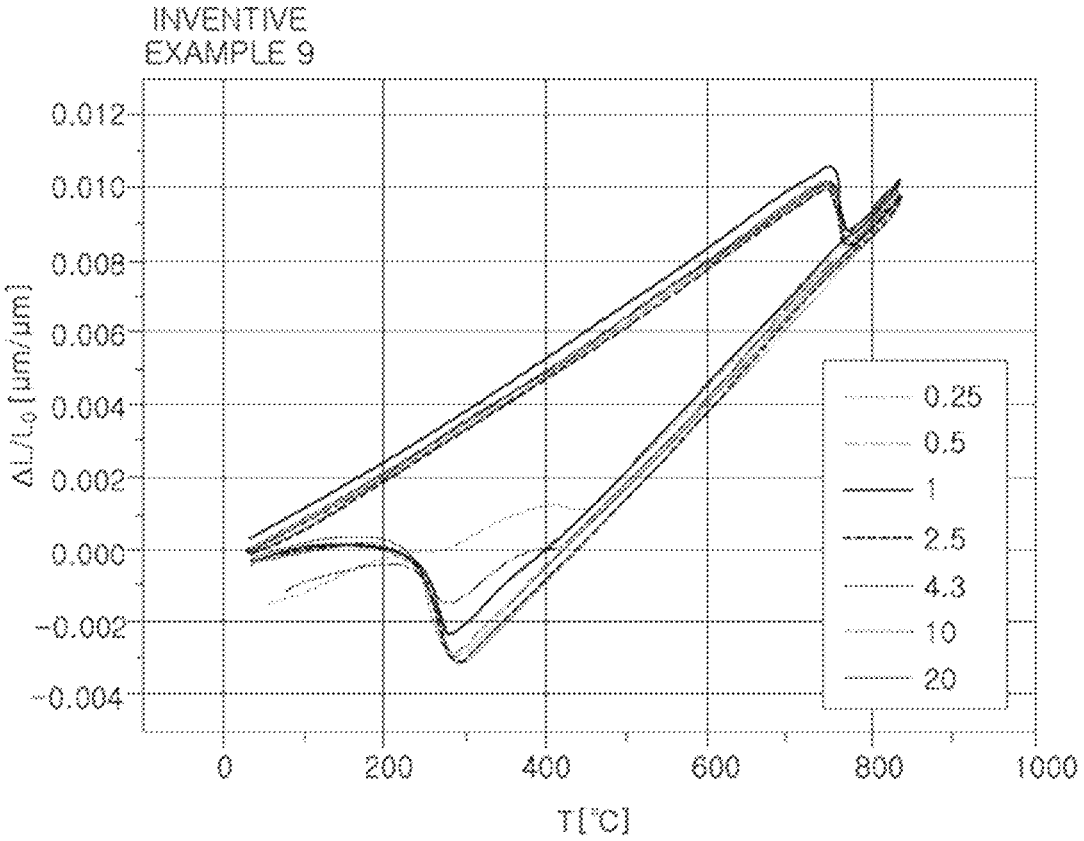

STEEL MATERIAL HAVING EXCELLENT HYDROGEN EMBRITTLEMENT RESISTANCE AND IMPACT TOUGHNESS AND METHOD FOR MANUFACTURING

CROSS-REFERENCE OF RELATED APPLICATIONS

This application is the U.S. National Phase under 35 U.S.C. § 371 of International Patent Application No. PCT/KR2021/009333, filed on Jul. 20, 2021, which in turn claims the benefit of Korean Application No. 10-2020-0099305, filed on Aug. 7, 2020, the entire disclosures of which applications are incorporated by reference herein.

TECHNICAL FIELD

The present disclosure relates to a steel having excellent hydrogen embrittlement resistance and impact toughness and a method for manufacturing the same.

BACKGROUND ART

The hydrogen economy refers to an economic system that uses hydrogen as an energy source instead of existing fossil fuels in daily life and industrial activities.

With the depletion of fossil fuels and the rise of environmental problems, the hydrogen economy is expected to expand in earnest in 20 years, and it is showing active movements such as announcing roadmaps for each country and the like with the goal of realizing a hydrogen economy at home and abroad.

As a means to realize the hydrogen economy, governments of respective countries are actively promoting not only the dissemination of hydrogen electric vehicles to expand hydrogen demand, but also the establishment of charging infrastructure such as hydrogen charging stations and the like to support the same.

A hydrogen charging station is infrastructure that stores hydrogen and supplies the same to users. The accumulator in the hydrogen charging station is a facility that is pressurized to a pressure higher than the filling pressure of the hydrogen fuel tank in the vehicle for differential pressure hydrogen charging into the hydrogen fuel tank mounted on hydrogen electric vehicles.

Currently, as the charging pressure of hydrogen electric vehicles increases from 350 bars to 700 bars, the accumulator pressure is also required to be 800 bars or higher.

As a material applicable to the accumulator in the hydrogen refueling station, there is STS316L austenitic steel having resistance to hydrogen embrittlement. However, in order to withstand a pressure of about 900 bars, it is not realistic enough to require a thickness of 405 mm, and there is a disadvantage of increasing the costs of constructing a charging station.

On the other hand, in the case of high-strength low-alloy steel, there is a possibility that phenomena such as a decrease in ductility, notch strength, impact toughness and the like may occur in a hydrogen gas atmosphere, but nevertheless, when the hydrogen embrittlement resistance of high-strength low-alloy steel is improved, it is expected to be an effective technology that may simultaneously satisfy the safety of hydrogen refueling stations and cost reductions.

Several techniques have been carried out to improve the hydrogen embrittlement resistance of high-strength low-alloy steels.

As an example, a steel having improved hydrogen resistance by using (V,Mo)C precipitates as a trap site for diffused hydrogen has been proposed (Patent Document 1). Specifically, it is disclosed that when the hydrogen embrittlement resistance according to the size of (V,Mo)C precipitates is quantified, the average diameter of the precipitates needs to be within the range of 1 to 20 nm, preferably 1 to 10 nm, more preferably 1 to 5 nm.

In addition, it is disclosed that Cu, Ni, Cr, Nb, W, B, etc. are further included for the purpose of improving the properties of steel. However, since the Ni is contained in a maximum of 12%, the manufacturing costs may be greatly increased when manufacturing steel, and there is a disadvantage in that it is not realistic to apply in a real environment.

In addition, it is disclosed that Nb, Ca, Mg, REM, etc. may be further included, but Nb and REM are rare earth metals, which are ultra-expensive elements, and are very high in price volatility, and therefore, there is a risk that a stable supply of raw materials may not be secured.

As another example, Patent Document 2 discloses a high-pressure hydrogen steel with a tensile strength of 900 to 1100 MPa and a yield ratio of 85% or more, and discloses that it contains W, Co, etc. for the purpose of improving the properties of the steel. However, since this also contains very expensive elements, there is a disadvantage in that manufacturing costs is greatly increased.

(Patent Document 1) Korean Patent Application Publication No. 2018-0038024

SUMMARY OF INVENTION

Technical Problem

An aspect of the present disclosure is to provide a steel material having improved hydrogen embrittlement resistance and high impact toughness despite a low-cost alloy system compared to conventional steel, and a method for manufacturing the same.

The subject of the present disclosure is not limited to the above. The subject of the present disclosure will be understood from the overall content of the present specification, and those of ordinary skill in the art to which the present disclosure pertains will have no difficulty in understanding the additional subject of the present disclosure.

Solution to Problem

According to an aspect of the present disclosure, a steel having excellent hydrogen embrittlement resistance and impact toughness includes, by weight %, carbon (C): 0.15-0.40%, silicon (Si): 0.4% or less (excluding 0%), manganese (Mn): 0.3-0.7%, sulfur (S): 0.01% or less (excluding 0%), phosphorus (P): 0.03% or less (excluding 0%), chromium (Cr): 0.6-2.0%, molybdenum (Mo): 0.15-0.8%, nickel (Ni): 1.6-4.0%, copper (Cu): 0.30% or less (excluding 0%), niobium (Nb): 0.12% or less (excluding 0%), nitrogen (N): 0.015% or less (excluding 0%), aluminum (Al): 0.06% or less (excluding 0%), boron (B): 0.007% or less (excluding 0%), and a balance of Fe and unavoidable impurity elements, wherein a relationship of a total content (SUM) of specific impurity elements and contents of the C, Cu, Nb, Ni, Cr and Mo satisfies the following relational expression 1, $$|(C\text{-}SUM)\cdot(Cu\text{-}SUM)\cdot(Nb\text{-}SUM)\cdot(Ni\text{-}SUM)\cdot(Cr\text{-}SUM)\cdot(Mo\text{-}SUM)|\times10^5>3.0, \quad \text{[Relational Expression 1]}$$

(where SUM is the total content of specific impurity elements, and means the total content (wt %) of [W+Nd+Zr+Co].)

According to another aspect of the present disclosure, a method of manufacturing a steel having excellent hydrogen embrittlement resistance and impact toughness includes preparing a steel slab satisfying the above-described alloy composition and Relational Expression 1 and heating the same at a temperature within a range of 1000 to 1200° C.; manufacturing a hot-rolled steel sheet by hot-rolling the heated steel slab to a finish rolling temperature which is Ar3 or higher; cooling the hot-rolled steel sheet to room temperature; an austenitizing operation of reheating the cooled hot-rolled steel sheet to a temperature range of 800 to 900° C. and then maintaining for 1 to 2 hours; cooling the austenitized hot-rolled steel sheet to room temperature at a cooling rate of 0.5 to 20° C./s; and a tempering operation of heat treatment for 30 minutes or more per 25 mm of steel sheet thickness in a temperature range of 580 to 680° C. after the cooling.

Advantageous Effects of Invention

According to the present disclosure, a steel material having excellent impact toughness as well as hydrogen embrittlement resistance while constructing a low-cost alloy system compared to existing steel materials may be provided.

The steel of the present disclosure has an advantageously applicable effect in the field using hydrogen, which is gradually increasing.

BRIEF DESCRIPTION OF DRAWINGS

FIG. 1 is a photograph of equipment capable of performing an ultra-low strain tensile test in a hydrogen environment.

FIG. 2A illustrates EBSD measurement photos of Comparative Examples 1-3 according to an embodiment of the present disclosure, FIG. 2B illustrates EBSD measurement photos of Inventive Examples 1, 3, 5 and 7 according to an embodiment of the present disclosure.

FIG. 3 is a photograph illustrating the distribution of precipitates by TEM and energy spectroscopy of Inventive Example 3 according to an embodiment of the present disclosure.

FIG. 4 is a graph illustrating the results of Relational Expression 2 of Comparative Examples and Inventive Examples according to an embodiment of the present disclosure.

FIGS. 5A to 5H illustrate the results of measuring the phase transformation change according to the cooling rate after austenitization of Comparative Examples and Inventive Examples with a dilatometer in an embodiment of the present disclosure, wherein FIGS. 5A-5C are comparison Examples 1-3 and FIGS. 5D-5H are results of Inventive Examples 1-9.

BEST MODE FOR INVENTION

The inventor of the present disclosure has studied in depth to develop a steel material that may be suitably used in a hydrogen environment, considering that the use of hydrogen is gradually expanded due to economic and environmental factors.

As a result, the present disclosure has been completed by confirming that it is confirmed that it is possible to provide a steel material with excellent hydrogen embrittlement resistance and high impact toughness by optimizing it as an alloy system at a lower cost compared to conventional steel and deriving a structure advantageous for securing intended physical properties by optimizing the steel manufacturing conditions.

In particular, the present disclosure has a technical significance in providing a target steel by obtaining the effect of using niobium (Nb) to refine the structure of the steel material to an effective grain size while configuring the structure of the steel material as a martensite matrix structure.

Hereinafter, the present disclosure will be described in detail.

A steel material having excellent hydrogen embrittlement resistance and impact toughness according to an aspect of the present disclosure may include, by weight %, carbon (C): 0.15-0.40%, silicon (Si): 0.4% or less (excluding 0%), manganese (Mn): 0.3-0.7%, sulfur (S): 0.01% or less (excluding 0%), phosphorus (P): 0.03% or less (excluding 0%), chromium (Cr): 0.6-2.0%, molybdenum (Mo): 0.15-0.8%, nickel (Ni): 1.6-4.0%, copper (Cu): 0.30% or less (excluding 0%), niobium (Nb): 0.12% or less (excluding 0%), nitrogen (N): 0.015% or less (excluding 0%), aluminum (Al): 0.06% or less (excluding 0%), and boron (B): 0.007% or less (excluding 0%).

Hereinafter, the reason for limiting the alloy composition of the steel provided in the present disclosure as above will be described in detail.

Meanwhile, unless otherwise specified in the present disclosure, the content of each element is based on the weight, and the ratio of the tissue is based on the area.

Carbon (C): 0.15 to 0.40%

Carbon (C) is an austenite stabilizing element, and is an element capable of controlling the Ae3 temperature and the martensite formation initiation temperature (Ms) according to the content thereof. In addition, as an interstitial element, it is very effective in securing strong strength by applying asymmetric distortion to the lattice structure of martensite. Moreover, it is an essential element for securing hardenability and securing a martensitic structure.

In order to sufficiently obtain the above-described effect, it is necessary to add C in an amount of 0.15% or more, but if the content exceeds 0.40%, carbide is excessively formed, and there is a disadvantage in that impact toughness and weldability are greatly reduced.

Accordingly, the C may be included in an amount of 0.15 to 0.40%.

Silicon (Si): 0.4% or Less (Excluding 0%)

Silicon (Si) is an element added as a deoxidizer during casting as well as solid solution strengthening. While Si serves to suppress the formation of carbon nitrides, in the present disclosure, it is necessary to improve hydrogen embrittlement resistance and impact toughness by forming fine carbon nitrides, and considering this, Si may be included in 0.4% or less. However, 0% may be excluded in consideration of the unavoidably added level.

Manganese (Mn): 0.3-0.7%

Manganese (Mn) is an austenite stabilizing element, and by greatly improving the hardenability of steel, it advantageously acts to form a hard phase such as martensite. In addition, it reacts with sulfur (S) to precipitate MnS, which is effective in preventing high-temperature cracking due to segregation of sulfur (S).

In order to sufficiently obtain the above-described effect, Mn may be included in an amount of 0.3% or more. However, if the content is excessive, there is a problem in that the austenite stability is excessively increased, and thus, it may be limited to 0.7% or less in consideration thereof.

Accordingly, the Mn may be included in an amount of 0.3 to 0.7%.

Sulfur (S): 0.01% or Less (Excluding 0%)

Sulfur (S) is an impurity unavoidably contained in steel, and if the content thereof exceeds 0.01%, there is a problem in that the ductility and weldability of the steel are inferior. Therefore, the S may be limited to 0.01% or less, and 0% may be excluded in consideration of the unavoidable level.

Phosphorus (P): 0.03% or Less (Excluding 0%)

Phosphorus (P) has a solid solution strengthening effect, but if the content thereof exceeds 0.03%, it causes brittleness of steel and has a problem of poor weldability. Therefore, the P may be limited to 0.03% or less, and 0% may be excluded in consideration of the unavoidable level.

Chromium (Cr): 0.6-2.0%

Chromium (Cr) is a ferrite stabilizing element and is an element that increases hardenability. According to the content of Cr, the Ae3 temperature and the temperature of the delta ferrite formation region are controlled. In addition, Cr reacts with oxygen (O) to form a dense and stable protective film of $Cr_2O_3$, which may improve corrosion resistance in a hydrogen environment, but also widens the formation temperature range of delta ferrite. As the content of Cr increases, the possibility that delta ferrite is formed during the casting process of steel increases, which remains even after heat treatment and adversely affects the properties of the steel.

Accordingly, in order to obtain effects such as improvement of hardenability and corrosion resistance by Cr, and the like, the content thereof is 0.6% or more, while may be limited to 2.0% or less in terms of suppressing the formation of delta ferrite.

Accordingly, the Cr may be included in an amount of 0.6 to 2.0%.

Molybdenum (Mo): 0.15-0.8%

Molybdenum (Mo) increases the hardenability of steel and is known as a ferrite stabilizing element. Mo improves the strength of the material through strong solid solution strengthening.

In order to sufficiently obtain the above-described effect, it may contain Mo in an amount of 0.15% or more. On the other hand, if the content is excessive, there is a possibility that the temperature range for forming delta ferrite is widened, and there is a concern that delta ferrite is formed and remains in the steel casting process. In consideration thereof, it is preferable to limit the Mo to 0.8% or less.

Accordingly, the Mo may be included in an amount of 0.15 to 0.8%.

Nickel (Ni): 1.6-4.0%

Nickel (Ni) is an effective element for improving the impact toughness of steel, and is added to improve the strength of steel without deterioration of low-temperature toughness. In addition, hydrogen embrittlement resistance may be improved by suppressing hydrogen diffusion into the steel.

In order to sufficiently obtain the above-described effect, Ni may be included in an amount of 1.6% or more, but as Ni is an expensive element, if the content exceeds 4.0%, there is a disadvantage that the manufacturing cost is greatly increased.

Accordingly, the Ni may be included in an amount of 1.6 to 4.0%.

Copper (Cu): 0.30% or Less (Excluding 0%)

Copper (Cu) is an element that improves the hardenability of a material, and is added to have a homogeneous structure in the steel material after heat treatment. If the content of Cu exceeds 0.30%, the possibility of generating cracks in the steel increases.

Therefore, the Cu may be included in an amount of 0.30% or less, and 0% is excluded.

Niobium (Nb): 0.12% or Less (Excluding 0%)

Niobium (Nb) may be one of the elements that form carbon nitrides of the M (C, N) form (where M means metal) and may improve hydrogen embrittlement resistance by forming fine carbon nitrides.

Although it will be described in detail later, the present disclosure has a feature of providing a method to suppress hydrogen embrittlement by constituting the base structure of the steel material with martensite and by trapping diffusible hydrogen using Nb-based precipitates semi-coherent with the martensite.

In addition, Nb serves to be solid-solubilized during reheating of the slab, inhibit austenite grain growth during hot rolling, and then precipitate to improve the strength of the steel.

If the content of Nb exceeds 0.12%, there is a fear that the weldability of the steel may be deteriorated, and the grains may be refined more than necessary.

Therefore, the Nb may be included in 0.12% or less, and 0% is excluded.

Nitrogen (N): 0.015% or Less (Excluding 0%)

Nitrogen (N) is difficult to completely remove industrially from steel, and is effective for austenite stabilization and carbon nitride formation. If the content of N exceeds 0.015%, there is a problem of increasing the possibility of defects in the steel by combining with boron (B) in the steel to form BN.

Therefore, the N may be included in 0.015% or less, and 0% is excluded.

Aluminum (Al): 0.06% or Less (Excluding 0%)

Aluminum (Al) enlarges the ferrite region and is added as a deoxidizer during casting.

In the case of the present disclosure, since elements effective for stabilizing ferrite other than Al are included, as the content of Al increases, the Ae3 temperature may increase excessively. In addition, if the content of Al exceeds 0.06%, there is a problem in that a large amount of oxide-based inclusions are formed to deteriorate the physical properties of the material.

Accordingly, the Al may be included in an amount of 0.06% or less, and 0% may be excluded in consideration of an unavoidable level.

Boron (B): 0.007% or Less (Excluding 0%)

Boron (B) is a ferrite stabilizing element, and even a very small amount contributes greatly to improving the hardenability of steel. In addition, it is easily segregated at the grain boundary, which is effective for the grain boundary strengthening effect.

If the content of B exceeds 0.007%, there is a high possibility of forming BN, and in this case, it is not preferable because it adversely affects the physical properties of the steel.

In consideration thereof, the B may be included in an amount of 0.007% or less, and 0% may be excluded.

The remaining component of the present disclosure is iron (Fe). However, since unintended impurities from raw materials or the surrounding environment may inevitably be mixed in the normal manufacturing process, this cannot be excluded. Since these impurities are known to anyone skilled in the art of manufacturing processes, all details thereof are not specifically mentioned in the present specification.

However, the steel material of the present disclosure preferably satisfies the following relational expression 1 for specific impurity elements.

$$|(C\text{-}SUM)\cdot(Cu\text{-}SUM)\cdot(Nb\text{-}SUM)\cdot(Ni\text{-}SUM)\cdot(Cr\text{-}SUM)\cdot(Mo\text{-}SUM)|\times10^5>3.0 \quad \text{[Relational Expression 1]}$$

(where SUM is the total content of specific impurity elements, and means the total content (wt %) of [W+Nd+Zr+Co].)

The steel material provided in the present disclosure satisfies the content of C, Cu, Nb, Ni, Cr and Mo in the steel, provided in satisfying the aforementioned alloy composition system, and impurity elements that may inhibit the beneficial effects of these elements may be necessary to control so that the impurity elements are not contained in the steel material of the present disclosure.

Specifically, when a specific value (Relational Expression 1) of the relationship between the sum (SUM) of contents of tungsten (W), neodymium (Nd), zirconium (Zr) and cobalt (Co) and the main elements of the present disclosure exceeds 3.0, the effect of the above main elements described in the present disclosure may be obtained.

On the other hand, in the present disclosure, W, Nd, and Zr, which are elements constituting the 'SUM', are relatively expensive elements and cause a large increase in the manufacturing cost of steel materials, and are difficult to apply in an actual use environment. In addition, since Co lowers hardenability, when included in steel, the intended structure (preferably, martensitic structure) may not be obtained in the process of cooling to room temperature by normalizing or quenching austenitized hot-rolled steel sheet under specific conditions by reheating. Therefore, the sum of weight % of alloy elements that should not be included in the steel material provided in the present disclosure is limited to 'SUM'.

The steel material of the present disclosure may ensure excellent hydrogen embrittlement resistance and high impact toughness by having the following microstructure and precipitate structure, which will be described in detail below.

In the steel material of the present disclosure, it is preferable that the matrix structure is composed of a tempered martensite phase, and the effective grain size (effective grain size) of the tempered martensite is preferably 5 μm or less in average diameter. More advantageously, it may be 3 μm or less.

In this case, the effective grain size indicates that the width size of the martensite block is measured and expressed as an average value using EBSD. Since blocks in martensite have high angle grain boundaries with each other, it can be seen as the smallest unit that affects the mechanical properties of steel.

In the steel material of the present disclosure, it is preferable that precipitates having a diameter of 20 nm or less are present in the above-described matrix structure in an amount of 20 pieces/$\mu m^2$ or more. If the number of precipitates with a diameter of 20 nm or less is less than 20/$\mu m^2$, the distance between the fine carbonitrides increases considerably, and accordingly, the target hydrogen embrittlement resistance improvement effect may not be obtained.

In the present disclosure, the precipitates having a diameter of 20 nm or less are fine carbonitrides composed of Nb, and may preferably mainly include Nb(C,N).

The steel material of the present disclosure that satisfies the above-described alloy composition system, Relational Expression 1 and the structural composition has excellent impact toughness as well as high strength, and specifically has an effect of having a tensile strength of 900 MPa or more and a Charpy impact energy value of 100 J or more at −20° C.

In addition, as the steel material of the present disclosure satisfies the relationship between a notch tensile strength ratio (RNTS, the ratio between the notch tensile strength (MPa) in an atmosphere in which hydrogen is charged to the sample and the notch tensile strength (MPa) in a normal air atmosphere) represented by the following relational expression 2, and the steel tensile strength (GPa), there is an excellent effect of hydrogen embrittlement resistance.

$$(\text{Notch tensile strength in hydrogen charged atmosphere (MPa)}\div\text{Notch tensile strength in normal air atmosphere (MPa)})\times\text{Steel tensile strength (GPa)}\geq0.7 \quad \text{[Relational Expression 2]}$$

Hereinafter, a method for manufacturing a steel material having excellent hydrogen embrittlement resistance and impact toughness, which is another aspect of the present disclosure, will be described in detail.

Briefly, in the present disclosure, the target steel may be manufactured through the process of [steel slab heating-hot rolling-cooling-reheating (austenitization)-cooling-tempering], but is not limited thereto.

The conditions for respective operations will be described in detail below.

First, after preparing a steel slab that satisfies the above-described alloy composition system and Relational Expression 1, the steel slab may be heated. In this case, the heating process is to facilitate the subsequent hot rolling process, and the temperature is not particularly limited, but may be performed in a temperature range of 1000 to 1200° C.

A hot-rolled steel sheet may be obtained by hot-rolling the steel slab heated according to the above. At this time, the hot rolling is preferably performed so that the finish rolling temperature is Ar3 or higher. In this manner, the uniformity of the structure may be increased by performing hot rolling at a temperature that becomes the austenite single-phase region.

The upper limit of the finish rolling temperature is not particularly limited, but if the temperature is excessively high, there is a problem in that the austenite grains become coarse, and therefore, in consideration thereof, it may be limited to 1000° C. or less. More advantageously, the finish rolling may be performed at 900 to 1000° C.

After the hot-rolled steel sheet manufactured as described above is cooled to room temperature (air cooling), it may be reheated to a high temperature to be austenitized.

At this time, the reheating is performed in a temperature range of 800 to 900° C., and it is preferable to maintain the temperature for at least 1 hour and at most 2 hours.

If the temperature at the time of reheating is less than 800° C., unintended carbides formed in the cooling process after hot rolling may not be sufficiently re-dissolved, whereas if the temperature exceeds 900° C., the grains may be coarsened and the physical properties of the steel may be inferior.

In addition, if the austenitization time is less than 1 hour, re-dissolution of unavoidable carbides formed during cooling after hot rolling may not be sufficiently obtained. On the other hand, if the time exceeds 2 hours, there is a risk that the properties of the steel may be inferior due to coarsening of the grains.

Thereafter, the austenitized hot-rolled steel sheet according to the above may be cooled to room temperature, and at this time, it may be performed at a cooling rate of 0.5 to 20° C./s. This cooling process may be a normalizing or quenching (quenching) process.

A martensite phase may be formed as a steel structure through the cooling process, and it is necessary to be careful not to generate ferrite and pearlite structures that greatly reduce matrix strength in this process.

Since the steel of the present disclosure contains elements advantageous for hardenability improvement, such as Cr, Mo, B, and the like, it is preferable to control the cooling rate to suppress the formation of ferrite and pearlite. Specifically, it is preferable to carry out the cooling at a cooling rate of 0.5° C./s or more, but if it exceeds 20° C./s, there is a risk of cracking due to a thermal gradient resulting from the difference in cooling rate between the thickness center and the surface of the steel sheet.

Subsequently, the hot-rolled steel sheet normalized or quenched (quenched) according to the above may be subjected to a tempering treatment. At this time, the tempering treatment may be performed by heat treatment at a temperature of 580 to 680° C. for 30 minutes or more per 25 mm of steel sheet thickness.

If the temperature during the tempering is less than 580° C., the precipitation of fine carbon-nitrides may not be induced within the heat treatment time due to the too low temperature. On the other hand, if the temperature exceeds 680° C., the material may be softened or the strength may be lowered due to the formation of an unintended tissue due to a dual phase region.

On the other hand, if the tempering time in the above temperature range is less than 30 minutes based on the thickness of the steel sheet 25 mm, there is a fear that the intended precipitate may not be properly formed because the heat is not sufficiently injected into the steel. Since the tempering time may be performed for a time for which a target precipitate is sufficiently generated, the upper limit thereof is not particularly limited, but it is advantageous not to exceed 120 minutes.

On the other hand, it is pointed out that the preferred thickness range of the steel provided in the present disclosure may be 25-100 mm.

After the tempering heat treatment is completed, it may be cooled to room temperature, and at this time, it is noted that it may be performed by air cooling.

Through the above-described series of processes, the target steel material in the present disclosure may be obtained. Preferably, the steel structure is composed of a tempered martensite phase, and by uniformly distributing specific carbonitrides therein, hydrogen embrittlement resistance and an improvement in impact toughness may be obtained.

Hereinafter, the present disclosure will be described in more detail through examples. However, it is necessary to note that the following examples are only intended to illustrate the present disclosure in more detail and are not intended to limit the scope of the present disclosure. This is because the scope of the present disclosure is determined by the matters described in the claims and matters reasonably inferred therefrom.

MODE FOR INVENTION

Example

After preparing a steel slab having an alloy composition illustrated in Table 1 below, it was heated at 1000 to 1200° C., and then finishing hot-rolled in Ar3 or higher to prepare a hot-rolled steel sheet having a thickness of 30 mm.

Thereafter, each hot-rolled steel sheet was reheated at various temperatures within the range of 800 to 900° C. for a minimum of 1 hour to a maximum of 2 hours to austenitize, and then cooled to room temperature by normalizing or quenching. At this time, cooling by normalizing or quenching was performed at a cooling rate within the range of 0.5 to 20° C./s.

Each hot-rolled steel sheet cooled according to the above was tempered at various temperatures within the range of 580 to 680° C. for at least 30 minutes per 25 mm of steel sheet thickness, and then air-cooled to room temperature to prepare a final steel material. At this time, the tempering time was performed so that it might not exceed 2 hours.

On the other hand, in Table 1 below, steel grades 1 to 3 are existing ASTM A723 steel grades, and all other steel grades satisfy the alloy composition proposed in the present disclosure.

For each of the steel materials manufactured as described above, semi-JIS No. 4 sub-size rod-shaped tensile specimens (total length 120 mm, parallel portions 32 mm, gauge diameter 6.25 mm) were prepared in the rolling direction, respectively. Then, using the ASTM E23 standard, an impact test specimen having a V-notch in the middle of a specimen having a width 10 mm×length 55 mm was produced in the same rolling direction, and impact toughness using a Charpy impact tester was evaluated, and the results are illustrated in Table 3 below. At this time, it means that the higher the absorbed energy, the better the toughness, and it is expressed as an average value after three measurements (however, in the case of steel grade 8, it was measured twice).

In addition, for the evaluation of the strength and hydrogen embrittlement resistance of each steel material, notched tensile specimens (notch diameter 3.6 mm, notch angle) 60° for hydrogen embrittlement testing conforming to ASTM G142 in the rolling direction were prepared, respectively.

Thereafter, Ultimate Tensile Strength (UTS) of semi-JIS No. 4 sub-size rod-shaped tensile specimens and notched tensile specimens were measured in the general atmosphere, and the results are illustrated in Table 3 below.

Meanwhile, in order for composition in an environment in which hydrogen is injected, the specimen is applied to a cell that may contain the 1N NaOH+3 g/L $NH_4SCN$ solution, and then hydrogen is injected into the specimen through continuous cathode hydrogen charging and at the same time, hydrogen embrittlement resistance was evaluated using equipment capable of performing the ultra-low strain tensile test (Slow Strain Rate Tensile test (SSRT), the apparatus of FIG. 1, tensile rate $1\times10^{-5}$/s), and the results are illustrated in Table 3.

Indices indicating the strength and hydrogen embrittlement resistance of a material are the relationship between the notch tensile strength ratio (RNTS=Notch tensile strength (MPa) in hydrogen charging atmosphere÷Notch tensile strength (MPa) in normal air atmosphere) and the tensile strength (GPa) of steel, and in the present disclosure, it is as relational expression 2. This is to apply the rate at which the strength deteriorates when hydrogen is charged to each specimen, and by multiplying the RNTS value by the tensile strength (GPa) of the material, the strength and hydrogen embrittlement resistance may be intuitively determined at the same time.

The type of microstructure was observed using a scanning electron microscope (SEM) for the same specimen as the rod-shaped tensile specimen, and the results are illustrated in Table 3.

And, the size of the effective crystal grain was confirmed by using Electron BackScatter Diffraction (EBSD), and the results are illustrated in FIG. 3.

In addition, the observed distribution of precipitates in the microstructure was observed using a transmission electron microscope (TEM) and energy spectroscopy, and the results are illustrated in FIG. 4.

TABLE 1

| Steel | Alloy Composition (wt %) | | | | | | | | | | | Relation |
|---|---|---|---|---|---|---|---|---|---|---|---|---|
| Grade | C | Si | Mn | Al | Cr | Ni | Mo | Nb | Cu | V | N | 1* |
| 1 | 0.045 | 0.198 | 0.302 | 0.004 | 1.19 | 3.30 | 0.58 | 0 | 0.001 | 0 | 0.0015 | 0.04 |
| 2 | 0.047 | 0.200 | 0.304 | 0.006 | 1.18 | 3.41 | 0.60 | 0.049 | 0.002 | 0 | 0.0015 | 0.3 |
| 3 | 0.048 | 0.201 | 0.299 | 0.006 | 1.18 | 3.41 | 0.60 | 0.097 | 0.001 | 0 | 0.0015 | 1.84 |
| 4 | 0.152 | 0.203 | 0.300 | 0.008 | 1.18 | 3.43 | 0.60 | 0.050 | 0.005 | 0 | 0.0015 | 5.22 |
| 5 | 0.154 | 0.206 | 0.301 | 0.007 | 1.18 | 3.43 | 0.60 | 0.106 | 0.003 | 0 | 0.0015 | 4.6 |
| 6 | 0.244 | 0.200 | 0.300 | 0.008 | 1.18 | 3.42 | 0.59 | 0.047 | 0.006 | 0 | 0.0015 | 10.3 |
| 7 | 0.251 | 0.202 | 0.300 | 0.008 | 1.18 | 3.44 | 0.59 | 0.100 | 0.008 | 0 | 0.0015 | 36.8 |
| 8 | 0.390 | 0.204 | 0.690 | 0.003 | 0.90 | 1.90 | 0.26 | 0.045 | 0.199 | 0 | 0.0015 | 149.3 |

P and S of all steel grades are 30 ppm or less, respectively, and B is 70 ppm or less. Since the content of these elements did not affect the physical properties of the steel, all numerical values were not entered .

'SUM', which is the content of impurity elements used to calculate

Relation 1*, was formulated as follows for each steel type.

Steel Grade 1: W (0.0008%), Nd (0.0006%), Zr (0.0008%), Co (0.0004%)

Steel Grade 2: W (0.0007%), Nd (0.0007%), Zr (0.0007%), Co (0.0005%)

Steel Grade 3: W (0.0008%), Nd (0.0004%), Zr (0.0006%), Co (0.0010%)

Steel Grade 4: W (0.0004%), Nd (0.0006%), Zr (0.0005%), Co (0.0005%)

Steel Grade 5: W (0.0003%), Nd (0.0003%), Zr (0.0006%), Co (0.0006%)

Steel Grade 6: W (0.0005%), Nd (0.0004%), Zr (0.0004%), Co (0.0007%)

Steel Grade 7: W (0.0002%), Nd (0.0003%), Zr (0.0005%), Co (0.0007%)

Steel Grade 8: W (0.0006%), Nd (0.0002%), Zr (0.0002%), Co (0.0001%)

TABLE 2

| Steel Grade | Reheat Temperature (° C.) | Cooling Method* | Cooling Rate (° C./s) | Tempering Temperature (° C.) |
|---|---|---|---|---|
| 1 | 830 | Q | 4.3 | 600 |
| 2 | 830 | Q | 4.3 | 600 |
| 3 | 830 | Q | 4.3 | 600 |
| 4 | 830 | Q | 20 | 600 |
| 4 | 830 | N | 4.3 | 600 |
| 5 | 830 | Q | 10 | 600 |
| 5 | 830 | N | 2.5 | 600 |

TABLE 2-continued

| Steel Grade | Reheat Temperature (° C.) | Cooling Method* | Cooling Rate (° C./s) | Tempering Temperature (° C.) |
|---|---|---|---|---|
| 6 | 830 | Q | 4.3 | 600 |
| 6 | 830 | N | 2.5 | 600 |
| 7 | 830 | Q | 4.3 | 600 |
| 7 | 830 | N | 0.5 | 600 |
| 8 | 860 | Q | 4.3 | 650 |

In the cooling method*, N means normalizing and Q means quenching.

TABLE 3

| Steel Grade | Microstructure | Tensile Strength | Atmospheric Environment Notch Tensile Strength (MPa) | Hydrogen Environment Notch Tensile Strength (MPa) | Relation 2 | CVN (@−20° C.) | Remark |
|---|---|---|---|---|---|---|---|
| 1 | T-B* | 700.5 | 1215.8 | 1104.5 | 0.64 | 161.3 | Comparative Example 1 |
| 2 | T-B | 773.3 | 1373.4 | 1202.5 | 0.68 | 227.7 | Comparative Example 2 |
| 3 | T-B | 740.5 | 1294.1 | 1122.5 | 0.64 | 57 | Comparative Example 3 |
| 4 | T-M* | 1007.1 | 1774.6 | 1327 | 0.75 | 190 | Inventive Example 1 |
| 4 | T-M | 1007.3 | 1771.0 | 1330 | 0.76 | 175.3 | Inventive Example 2 |
| 5 | T-M | 1011.7 | 1738.4 | 1356 | 0.79 | 195.3 | Inventive Example 3 |
| 5 | T-M | 1014.3 | 1739.7 | 1349.5 | 0.79 | 192 | Inventive Example 4 |
| 6 | T-M | 1014.4 | 1733.7 | 1216.5 | 0.71 | 158.3 | Inventive Example 5 |
| 6 | T-M | 1012.3 | 1733.8 | 1221.5 | 0.71 | 157 | Inventive Example 6 |

TABLE 3-continued

| Steel Grade | Microstructure | Tensile Strength | Atmospheric Environment Notch Tensile Strength (MPa) | Hydrogen Environment Notch Tensile Strength (MPa) | Relation 2 | CVN (@−20° C.) | Remark |
|---|---|---|---|---|---|---|---|
| 7 | T-M | 1019.8 | 1739.3 | 1203 | 0.71 | 147.7 | Inventive Example 7 |
| 7 | T-M | 1017.8 | 1736.9 | 1206.5 | 0.71 | 148 | Inventive Example 8 |
| 8 | T-M | 1047 | 1561.3 | 1401.3 | 0.94 | 101.5 | Inventive Example 9 |

T-B* stands for tempered bainite, and T-M* stands for tempered martensite.

As illustrated in Table 3, it may be confirmed that Inventive Examples 1 to 9, which satisfy the alloy composition system and manufacturing conditions according to the present disclosure, have excellent hydrogen embrittlement resistance compared to Comparative Examples 1 to 3 corresponding to conventional steel, as well as excellent impact toughness by ensuring that the impact absorbed energy value is 100 J or more (maximum 195J or more) at −20° C.

FIG. 2A is EBSD measurement results of Comparative Examples 1-3, and FIG. 2B is EBSD measurement results of Inventive Examples 1, 3, 5, and 7, and the size of effective crystal grains may be confirmed.

According to FIG. 2B, the effective grain size of the inventive examples is 3 μm or less, which is very fine compared to the comparative examples of FIG. 2A. Although a separate measurement photograph is not illustrated for Inventive Example 9, the results were similar to those of the Inventive Examples above.

FIG. 3 is a photograph provided by observing the distribution of precipitates by TEM and energy spectroscopy of Inventive Example 3;

In FIG. 3*a*, the Nb precipitate is indicated by a yellow arrow, and it can be seen that the size is approximately 20 nm or less.

On the other hand, although not specified, cementite containing Fe was observed in Comparative Examples 1 to 3, and although some cementite was observed in Inventive Example 3 corresponding to the present disclosure (FIG. 3*b*), the size of the Nb precipitates is very small and finely distributed as compared with this cementite, and thus, it will be distinguished (FIG. 3*c*).

FIG. 4 is a graph illustrating the values of Relational Expression 2 of Comparative Examples 1 to 3 and Inventive Examples 1 to 9. As illustrated in FIG. 4, it can be seen that in Comparative Examples 1 to 3, all values of Relational expression 2 are less than 0.7, whereas all of the Inventive Examples had a value of 0.7 or more.

On the other hand, in order to confirm the change in the phase transformation according to the cooling rate after austenitization of each steel grade, the hot-rolled steel sheet obtained by hot rolling is subjected to austenitization (reheating temperature in Table 2), and then cooled at different cooling rates (0.25, 0.5, 1.0, 2.5, 4.3, 10, 20° (C/s)), and thus, the phase transformation was confirmed with a dilatometer. The results are illustrated in FIGS. 5A to 5H.

Comparative Examples 1 to 3 are examples outside the alloy composition proposed in the present disclosure, and as illustrated in FIGS. 5A to 5C, transformation behavior into bainite is confirmed. Meanwhile, the inventive examples (FIGS. 5D to 5H) according to the present disclosure all illustrate martensite transformation behavior in the cooling rate range (0.5-20° C./s) of the present disclosure, and the temperature is approximately 300-400° C.

The invention claimed is:

1. A steel having, comprising:

by weight %, carbon (C): 0.15-0.40%, silicon (Si): 0.4% or less (excluding 0%), manganese (Mn): 0.3-0.7%, sulfur (S): 0.01% or less excluding 0%, phosphorus (P): 0.03% or less excluding 0%, chromium (Cr): 0.6-2.0%, molybdenum (Mo): 0.15-0.8%, nickel (Ni): 1.6-4.0%, copper (Cu): 0.30% or less excluding 0%, niobium (Nb): 0.12% or less excluding 0%, nitrogen (N): 0.015% or less excluding 0%, aluminum (Al): 0.06% or less excluding 0%, boron (B): 0.007% or less excluding 0%, and a balance of Fe and unavoidable impurity elements, wherein a relationship of a total content SUM of specific impurity elements and contents of the C, Cu, Nb, Ni, Cr and Mo satisfies the following relational expression 1, wherein in a microstructure of the steel, 20/μm$^2$ or more precipitates having a diameter of 20 nm or less are present, wherein the precipitates having the diameter of 20 nm or less are Nb(C, N), $$|(C\text{-}SUM)\cdot(Cu\text{-}SUM)\cdot(Nb\text{-}SUM)\cdot(Ni\text{-}SUM)\cdot(Cr\text{-}SUM)\cdot(Mo\text{-}SUM)|\times10^5>3.0, \quad \text{[Relational Expression 1]}$$

where SUM is the total content of specific impurity elements, and means the total content in wt % of [W+Nd+Zr+Co].

2. The steel of claim 1, wherein the steel has a microstructure composed of tempered martensite, and has an effective grain size of 5 μm or less in average diameter.

3. The steel of claim 1, wherein the steel has a tensile strength of 900 MPa or more, and a Charpy impact energy value of 100 J or more at −20° C.

4. The steel of claim 1, wherein in the steel, a relationship between a notch tensile strength ratio RNTS, which is defined as a ratio between a notch tensile strength in an atmosphere in which hydrogen is charged to a sample and a notch tensile strength in a normal air atmosphere, and a steel tensile strength in GPa satisfies the following relational expression 2, $$(\text{Notch tensile strength in MPa in hydrogen charged atmosphere}\div\text{Notch tensile strength in MPa in normal air atmosphere})\times\text{Steel tensile strength in GPa}\geq0.7. \quad \text{[Relational Expression 2]}$$

* * * * *